US009939228B2

(12) United States Patent
Cheng et al.

(10) Patent No.: US 9,939,228 B2
(45) Date of Patent: Apr. 10, 2018

(54) FREE FLOAT HANDGUARD FOR FIREARM

(71) Applicants: Carson Cheng, City of Industry, CA (US); Jason Michael Cheng, City of Industry, CA (US); Richard Thomas, City of Industry, CA (US)

(72) Inventors: Carson Cheng, City of Industry, CA (US); Jason Michael Cheng, City of Industry, CA (US); Richard Thomas, City of Industry, CA (US)

(73) Assignee: NcSTAR, Inc., City of Industry, CA (US)

( * ) Notice: Subject to any disclaimer, the term of this patent is extended or adjusted under 35 U.S.C. 154(b) by 0 days.

(21) Appl. No.: 15/249,456

(22) Filed: Aug. 28, 2016

(65) Prior Publication Data

US 2018/0058807 A1 Mar. 1, 2018

(51) Int. Cl.
*F41C 23/16* (2006.01)
*F41A 5/26* (2006.01)

(52) U.S. Cl.
CPC ..... *F41C 23/16* (2013.01); *F41A 5/26* (2013.01)

(58) Field of Classification Search
CPC ..... F41C 23/16; F41A 5/26
See application file for complete search history.

(56) References Cited

U.S. PATENT DOCUMENTS

| | | | | |
|---|---|---|---|---|
| 6,959,509 | B2 * | 11/2005 | Vais | F41A 21/482 42/75.02 |
| 8,359,779 | B2 * | 1/2013 | Daniel | F41C 23/16 42/71.01 |
| 8,806,792 | B2 * | 8/2014 | Yan | F41C 23/16 42/71.01 |
| D723,130 | S * | 2/2015 | Barrett | D22/108 |
| 9,303,949 | B1 * | 4/2016 | Oglesby | F41A 3/66 |
| 9,528,793 | B1 * | 12/2016 | Oglesby | F41C 23/16 |
| 9,557,137 | B2 * | 1/2017 | Dzwill | F41C 23/16 |

OTHER PUBLICATIONS

Glock24, "JP Enterprises Free Float handguard", Sep. 7, 2006, ar15.com.*

* cited by examiner

*Primary Examiner* — Stephen Johnson
*Assistant Examiner* — Joshua T Semick
(74) *Attorney, Agent, or Firm* — Raymond Y. Chan; David and Raymond Patent Firm

(57) ABSTRACT

A free float handguard for a firearm having a barrel includes a handguard body and a locking arrangement. The locking arrangement includes a barrel locker and a handguard locker. The barrel locker includes a first tubular locker adapted for coaxially coupling at a fixed end of the barrel, and a second tubular locker coaxially and rotatably coupled at the first tubular locker. The handguard locker has a rear portion coaxially coupled at the first tubular locker to prevent the handguard locker from being rotated therearound, and a front portion engaged with the second tubular locker to prevent the second tubular locker from being rotated around the first tubular locker, wherein a first end portion of the handguard body is coupled at the handguard locker for locking up the handguard body around the barrel in a free float manner.

14 Claims, 6 Drawing Sheets

FREE FLOAT HANDGUARD FOR FIREARM

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a handguard of a rifle, and more particularly to a free float handguard, which is only supported by a fixed end of a barrel to encircle the barrel within the free float handguard.

Description of Related Arts

A long firearm, such as a rifle, generally comprises a lengthened firearm body and a barrel extended therefrom. The shooter usually uses two hands to hold the rifle by two hands at a fired position. Especially, one hand of the shooter holds the rifle at a trigger of the firearm body and another hand holds the rifle under the barrel in order to maintain the balance of the firearm at the fired position. However, due to the heat generated along the barrel during the firing operation, a handguard must be mounted around the barrel to protect the hand of the shooter.

The conventional handguard generally comprises a locking ring attached to the barrel, an upper casing and a lower casing detachably coupled with each other to form a tubular configuration to lock at the locking ring for encircling around the barrel, wherein two ends of the handguard are mounted and supported by the barrel. As a result, any external force at the handguard will transmit to the barrel and will cause the distortion of the barrel, so as to cause the bullet deflection. In addition, the installation of the handguard is complicated to align and match the upper casing with the lower casing. Additional fasteners are required for coupling the upper casing with the lower casing that increases the overall weight of the handguard.

Most firearms may incorporate with a gas tube for releasing gas from the barrel after firing. However, the conventional handguard does not include any mechanism to retain the gas tube in position. Some improved handguards may modify the locking ring to form a slot at an inner circumferential side, such that the gas tube can pass through the slot within the locking ring. However, the size of the locking ring will be increased in order to enable the gas tube passing therethrough. As a result, the size of the handguard will also be increased by the locking ring. It is worth mentioning that since the gas tube is guided to pass through the interior of the locking ring, the gas tube does not supported by the locking ring. In fact, the locking ring is supported by the gas tube, such that the external force applied to the handguard will also transmit to the gas tube and will cause the damage of the gas tube.

SUMMARY OF THE PRESENT INVENTION

The invention is advantageous in that it provides a free float handguard for a firearm, which is only supported by a fixed end of a barrel to encircle the barrel within the free float handguard.

Another advantage of the invention is to provide a free float handguard, which comprises a barrel locker to lock up at the barrel of the firearm and a handguard locker to lock up with a handguard body, such that when the barrel locker and the handguard locker is interlocked with each other, the handguard body is securely locked up with the firearm to encircle around the barrel.

Another advantage of the invention is to provide a free float handguard, wherein the barrel locker is rotatably adjusted to align with a gas tube of the firearm in order to guide and support the gas tube to be extended toward the barrel.

Another advantage of the invention is to provide a free float handguard, wherein the handguard body can be rigidly supported around the barrel in a suspended manner to protect the hand of the shooter from the barrel.

Another advantage of the invention is to provide a free float handguard, wherein the installation of the free float handguard is simply and easy by coaxially coupling with the barrel locker, the handguard locker and the handguard body with each other.

Another advantage of the invention is to provide a free float handguard, wherein the locking arrangement can be incorporated with any existing handguard to be mounted to the firearm.

Another advantage of the invention is to provide a free float handguard, which does not require to alter the original structural design of the firearm, so as to minimize the manufacturing cost of the firearm incorporating with the free float handguard.

Another advantage of the invention is to provide a free float handguard, wherein no expensive or complicated structure is required to employ in the present invention in order to achieve the above mentioned objects. Therefore, the present invention successfully provides an economic and efficient solution for rigidly and securely mounting the handguard at the firearm to protect the hand of the shooter.

Additional advantages and features of the invention will become apparent from the description which follows, and may be realized by means of the instrumentalities and combinations particular point out in the appended claims.

According to the present invention, the foregoing and other objects and advantages are attained by a free float handguard for a firearm having a barrel, wherein the free float handguard comprises a handguard body and a locking arrangement.

The handguard body, which has a tubular configuration, has a first end portion and a second end portion, wherein the handguard body has a non-circular cross section.

The locking arrangement comprises a barrel locker and a handguard locker. The barrel locker comprises a first tubular locker adapted for coaxially coupling at a fixed end of the barrel, and a second tubular locker coaxially and rotatably coupled at the first tubular locker. The handguard locker has a rear portion coaxially coupled at the first tubular locker to prevent the handguard locker from being rotated therearound, and a front portion engaged with the second tubular locker to prevent the second tubular locker from being rotated around the first tubular locker, wherein the first end portion of the handguard body is coupled at the handguard locker for locking up the handguard body around the barrel.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
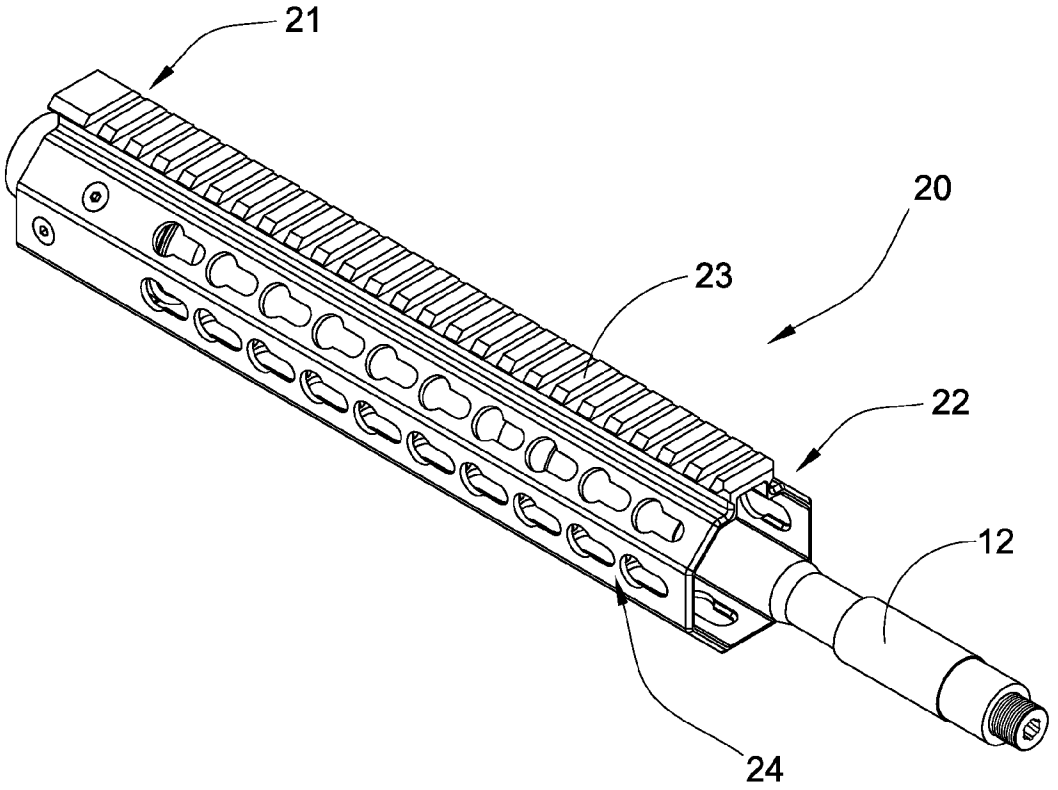
FIG. 1 is a perspective view of a free float handguard coupled at a barrel of a firearm according to a preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 6 of the drawings, a free float handguard for a firearm according to a preferred embodiment of the present invention is illustrated, wherein the firearm is embodied as a long firearm, such as a rifle. The firearm comprises a firearm body 11, a barrel 12 extended therefrom to define a barrel direction, and a gas tube 13 extended from the firearm body 11 toward the barrel 12 along the barrel direction. In particular, the barrel 12 has a free end and an opposed fixed end coupled at the firearm body 11.

According to the preferred embodiment, the free float handguard comprises a handguard body 20 and a locking arrangement coupled at the firearm to lock up the handguard body 20 that the barrel 11 is encircled within the handguard body 20.

The handguard body 20 has a tubular configuration and has a non-circular cross section. In one embodiment, the handguard body 20 has an octagonal cross section, wherein the handguard body 20 has eight elongated faces. The handguard body 20 further has a first end portion 21 extended toward the fixed end of the barrel 12 and a second end portion 22 extended toward the free end of the barrel 12, wherein the barrel 12 is coaxially aligned within the handguard body 20. Preferably, a length of the handguard body 20 is shorter than a length of the barrel 12, such that the free end of the barrel 12 is extended out of the handguard body 20 at the second end portion 22 thereof.

Figure 2:
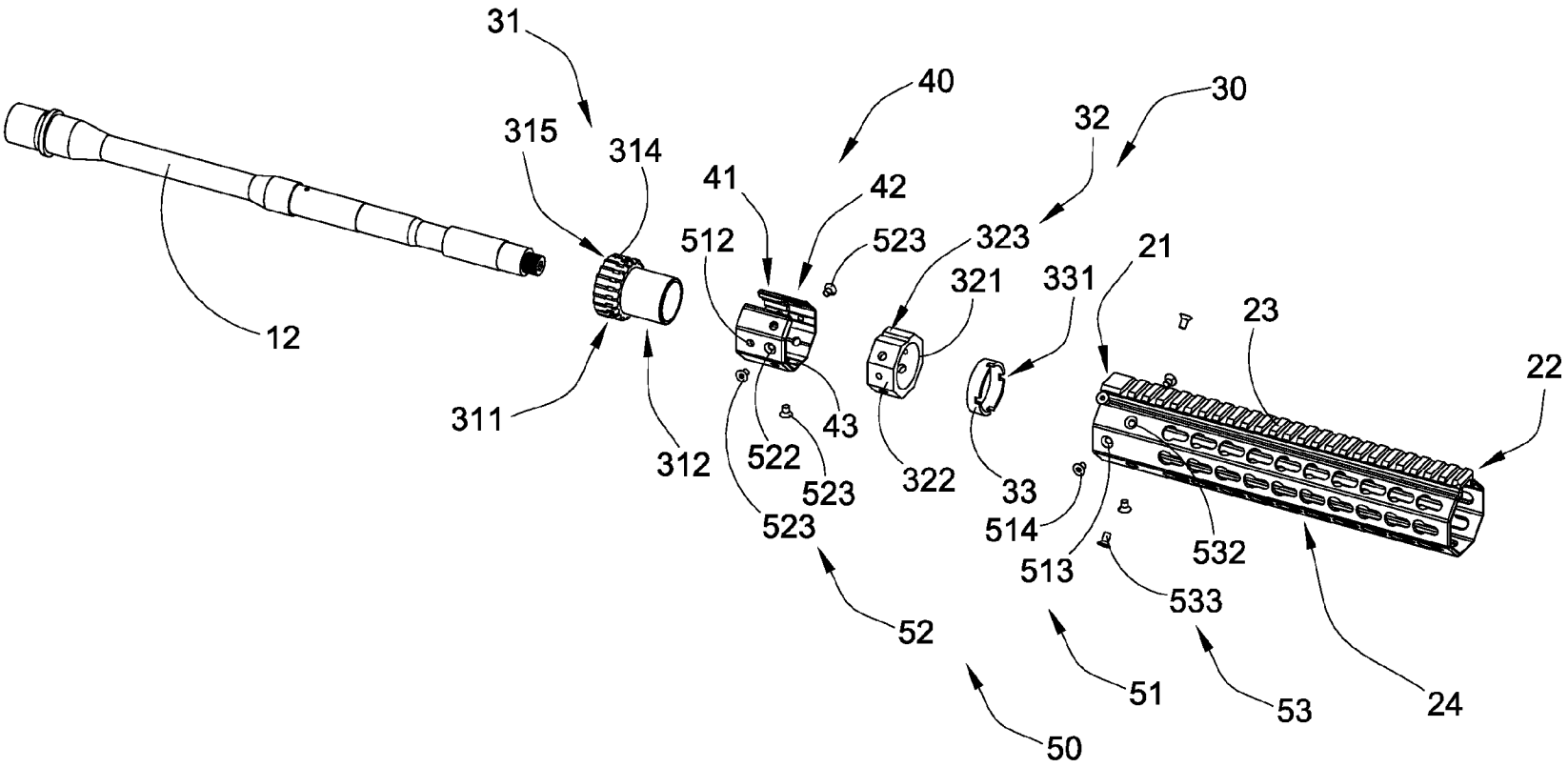
FIG. 2 is an exploded perspective view of the free float handguard according to the above preferred embodiment of the present invention.

As shown in FIG. 2, the handguard body 20 comprises one or more rail systems formed thereat. Preferably, a first rail system 23, such as "Picatinny rail system", is provided at one face of the handguard body 20, wherein the first rail system 23 comprises a plurality of T-shaped cross sectional raised ridges formed at the corresponding face of the handguard body 20. A second rail system 24, such as "KeyMod" rail system, is provided at the other faces of the handguard body 20, wherein the second rail system 24 has a plurality of "KeyMod" slots, each having a keyhole configuration, provided at the each corresponding face of the handguard body 20. It is worth mentioning that the handguard body 20 has a one piece structure that no detachable component, such as the conventional upper or lower casing, is formed at the handguard body 20.

As shown in FIG. 2, the locking arrangement comprises a barrel locker 30 and a handguard locker 40. Accordingly, the barrel locker 30 is arranged for detachably coupling at the barrel 12 and the handguard locker 40 is arranged for detachably coupling with the handguard body 20. Therefore, when the barrel locker 30 and the handguard locker 40 are detachably coupled with each other, the handguard body 20 is supported to encircle the barrel 12.

Figure 3:
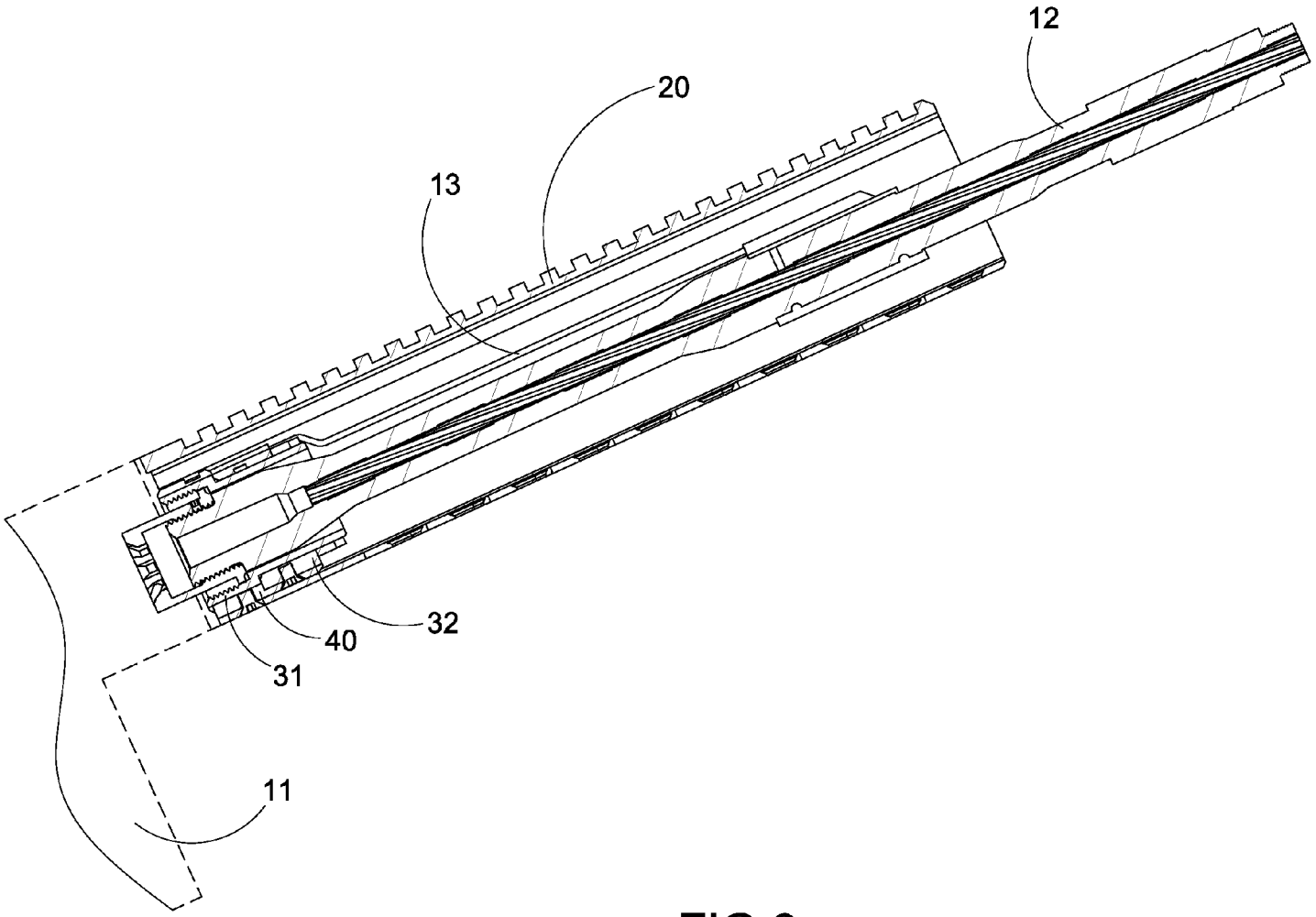
FIG. 3 is a sectional view of the free float handguard coupled at the barrel according to the above preferred embodiment of the present invention.

As shown in FIGS. 2 and 3, the barrel locker 30 comprises a first tubular locker 31 adapted for coaxially coupling at the fixed end of the barrel 12, and a second tubular locker 32 coaxially and rotatably coupled at the first tubular locker 31.

The handguard locker 40 has a rear portion 41 coaxially coupled at the first tubular locker 31 to prevent the handguard locker 40 from being rotated therearound, and a front portion 42 engaged with the second tubular locker 32 to prevent the second tubular locker 32 from being rotated around the first tubular locker 31, wherein the first end portion 21 of the handguard body 20 is coupled at the handguard locker 40 for locking up the handguard body 20 around the barrel 12. It is worth mentioning that only the first end portion 21 of the handguard body 20 is coupled at the barrel 12, such that the second end portion 22 of the handguard body 20 is supported in a suspended manner to generate a free float effect.

Figure 4:
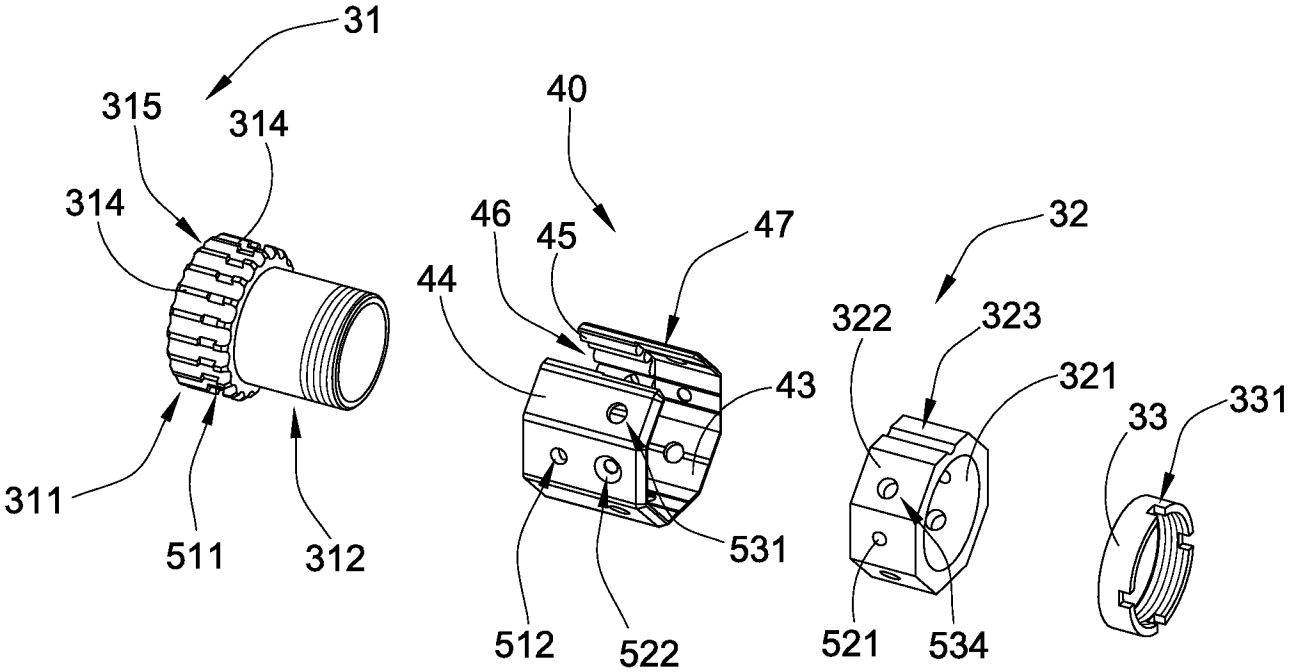
FIG. 4 is an exploded perspective view of the locking arrangement of the free float handguard according to the above preferred embodiment of the present invention.
Figure 5:
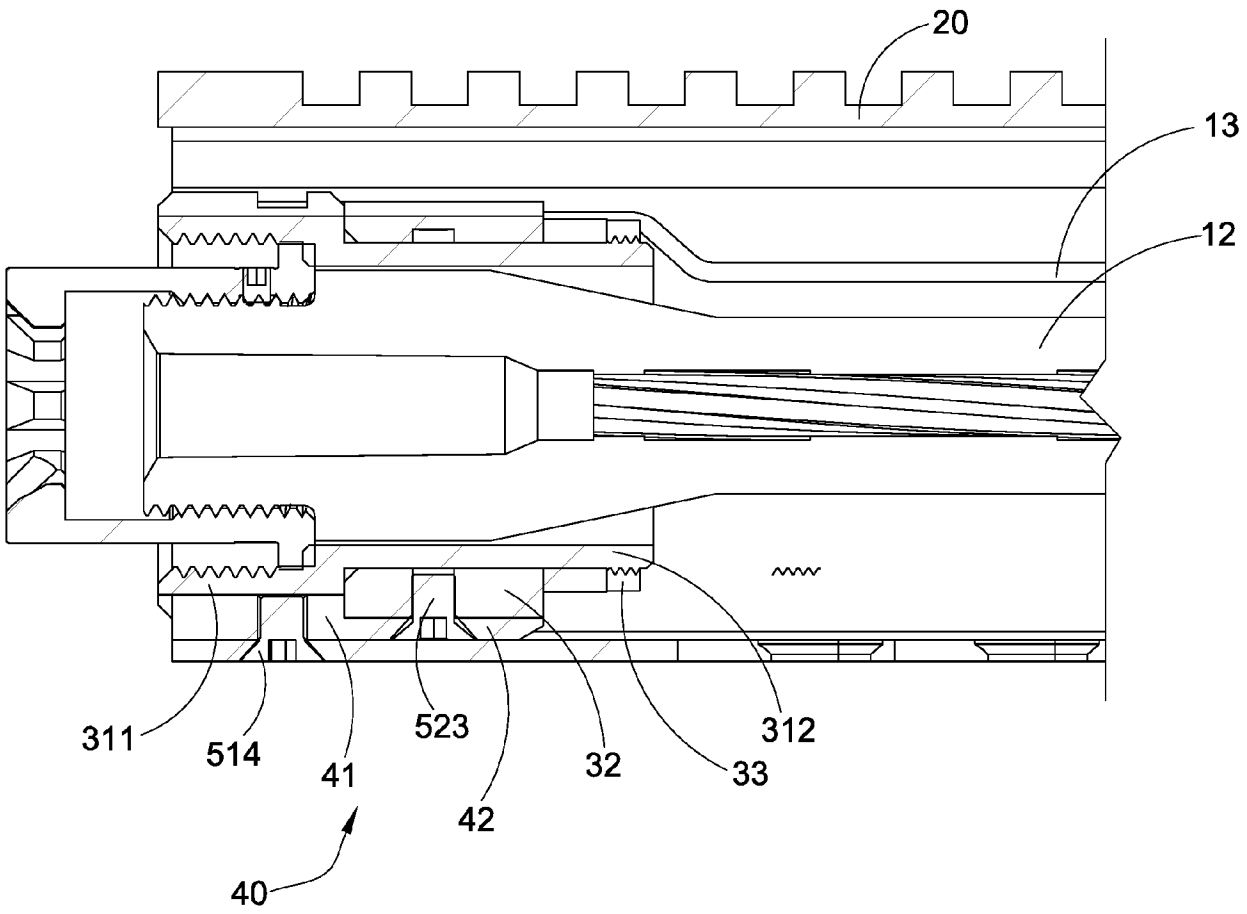
FIG. 5 is a sectional view of the locking arrangement of the free float handguard coupled at the barrel according to the above preferred embodiment of the present invention.

As shown in FIGS. 4 and 5, the first tubular locker 31 has a rear locking portion 311 and a front coupling portion 312 coaxially extended therefrom. Accordingly, an outer diameter of the rear locking portion 311 of the first tubular locker 31 is larger than an outer diameter of the front coupling portion 312 thereof. An inner diameter of the rear locking portion 311 of the first tubular locker 31 is the same as an inner diameter of the front coupling portion 312 thereof. As shown in FIG. 5, the first tubular locker 31 has an inner threaded structure 313 for rotatably coupling at the fixed end of the barrel 12.

Figure 6:
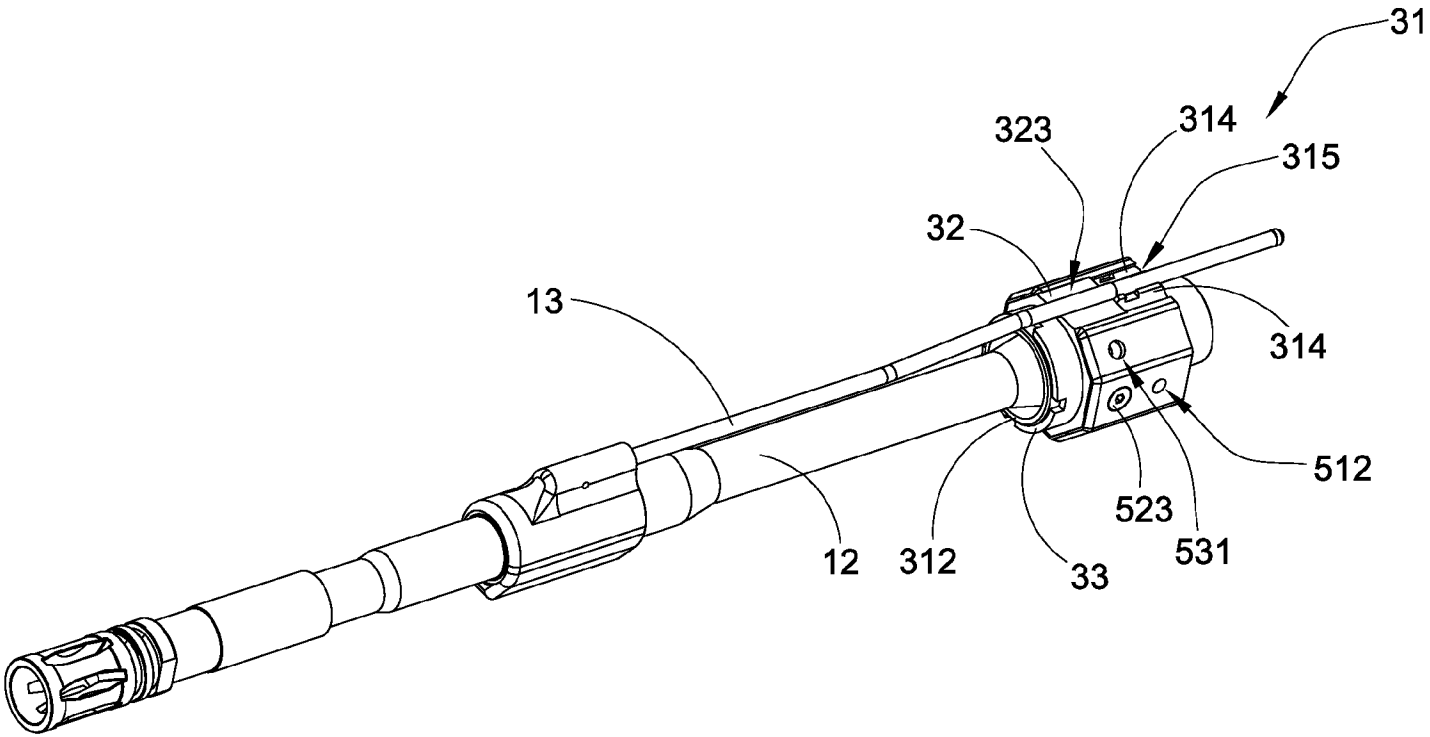
FIG. 6 illustrates the gas tube of the firearm being guided and supported by the locking arrangement of the free float handguard to extend toward the barrel according to the above preferred embodiment of the present invention.

The first tubular locker 31 further comprises a plurality of locking ribs 314 outwardly and radially extended from the rear locking portion 311 to form a plurality of locking grooves 315 between the locking ribs 314. In other words, each of the locking grooves 315 is extended along the barrel direction of the barrel 12 and is formed between two adjacent locking ribs 314. Accordingly, one of the locking grooves 315, preferably at the uppermost position, serves as a gas tube channel formed on the rear locking portion 311 of the first tubular locker 31 for guiding and supporting the gas tube 13 of the firearm extended toward the barrel 12, as shown in FIG. 6. In other words, a portion of the gas tube 13 is disposed along the corresponding groove 315. It is worth mentioning that the first tubular locker 31 is rotatably engaged at the fixed end of the barrel 12, such that when the first tubular locker 31 is tightened at the fixed end of the barrel 12, the first tubular locker 31 can be slightly rotated to locate one of the locking grooves 315 at the uppermost position to serve as the gas tube channel.

The second tubular locker 32 is coaxially coupled at the front coupling portion 312 of the first tubular locker 31. In particular, the second tubular locker 32 has a circular inner surface 321 and a non-circular outer surface 322. An inner diameter of the second tubular locker 32 is slightly larger than the outer diameter of the front coupling portion 312 of the first tubular locker 31, such that the front coupling portion 312 of the first tubular locker 31 can coaxially pass through the second tubular locker 32. When the circular inner surface 321 of the second tubular locker 32 is coaxially coupled at the front coupling portion 311 of the first tubular locker 31, the second tubular locker 32 is adapted to be rotated around the front coupling portion 312 of the first tubular locker 31. It is worth mentioning that a length of the second tubular locker 32 is shorter than a length of the front coupling portion 312 of the first tubular locker 31.

The shape of the non-circular outer surface 322 of the second tubular locker 32 has the same cross section of the handguard body 20. In other words, the non-circular outer surface 322 of the second tubular locker 32 has an octagonal shape to define eight faces of the circular outer surface 322 of the second tubular locker 32.

The second tubular locker 32 further has a gas tube slot 323 indented on the non-circular outer surface 322 of the second tubular locker 32. Preferably, the gas tube slot 323 is indented on one of the faces of the circular outer surface 322 of the second tubular locker 32. Therefore, the second tubular locker 32 rotated at the front coupling portion 312 of the first tubular locker 31 to align the gas tube slot 323 with the gas tube channel for guiding and supporting the gas tube 13 of the firearm extended toward the barrel 12.

Accordingly, the barrel locker 30 further comprises a retention ring 33 coupled at the front coupling portion 312 of the first tubular locker 31 to retain the second tubular locker 32 between the rear locking portion 311 of the first tubular locker 31 and the retention ring 33. The retention ring 33 further has one or more guiding indentions 331 indented at a front edge of the retention ring 33, wherein the gas tube 13 is guided to extend from the gas tube slot 323 with the gas tube channel to the barrel 12 through one of the guiding indentions 331, as shown in FIG. 6.

Preferably, the retention ring 33 has an inner threaded structure formed at an inner circumferential surface thereof, wherein a corresponding outer threaded structure is formed at a front end of the front coupling portion 312 of the first tubular locker 31, such that the retention ring 33 is rotatably coupled at the front coupling portion 312 of the first tubular locker 31 via the inner and outer threaded structures.

According to the preferred embodiment, the handguard locker 40 has a non-circular cross section. In one embodiment, the cross section of the handguard locker 40 matches with the cross section of the handguard body 20. In other words, the handguard locker 40 has an octagonal cross section to have eight faces.

The handguard locker 40 further has an inner circumferential surface 43 and an outer circumferential surface 44. The inner circumferential surface 43 of the handguard locker 40 at the rear portion 41 thereof is engaged with the rear locking portion 311 of the first tubular locker 31 and the inner circumferential surface 43 of the handguard locker 40 at the front portion 42 thereof is biased against the non-circular outer surface 322 of the second tubular locker 32 so as to lock up the handguard body 20 around the barrel 12. The outer circumferential surface 44 of the handguard locker 40 has a cross section matching a cross section of the handguard body 20. Accordingly, the outer circumferential surface 44 of the handguard locker 40 is coupled with the first end portion 21 of the handguard body 20. In other words, the handguard locker 40 is inserted into the handguard 20 to overlap the first end portion 21 of the handguard body 20 on the outer circumferential surface 44 of the handguard locker 40.

As shown in FIG. 4, the handguard locker 40 further comprises a plurality of engaging ribs 45 inwardly and radially extended from the rear portion 41 of the inner circumferential surface 43 to form a plurality of engaging grooves 46 between the engaging ribs 45. In other words, each of the engaging grooves 46 is extended along the barrel direction of the barrel 12 and is formed between two adjacent engaging ribs 45. Accordingly, the locking ribs 314 are engaged with the engaging grooves 46 respectively and the engaging ribs 45 are engaged with the locking grooves 315 to interlock the handguard locker 40 with the first tubular locker 31. In particular, the rear portion 41 of the handguard locker 40 is interlocked with the rear locking portion 311 of the first tubular locker 31.

It is worth mentioning that when the handguard locker 40 is interlocked with the first tubular locker 31, the handguard locker 40 cannot be rotated around the first tubular locker 31. In addition, when the front portion 42 of the handguard locker 40 is engaged with the second tubular locker 32, the second tubular locker 32 cannot be rotated around the front coupling portion 312 of the first tubular locker 31. In other words, once the second tubular locker 32 is rotated at the front coupling portion 312 of the first tubular locker 31 to align the gas tube slot 323 with the gas tube channel, the front portion 42 of the handguard locker 40 is engaged with the second tubular locker 32 to lock up rotational movement of the second tubular locker 32.

The handguard locker 40 has a C-shape defining a gas tube slit 47 between two edges thereof to align with the gas tube channel and the gas tube slot 323 for guiding the gas tube 13 of the firearm extended toward the barrel 12. In other words, once the second tubular locker 32 is rotated at the front coupling portion 312 of the first tubular locker 31 to align the gas tube slot 323 with the gas tube channel, the handguard locker 40 is engaged with the second tubular locker 32 to align the gas tube slit 47 with the gas tube channel and the gas tube slot 323, as shown in FIG. 6. It is worth mentioning that the gas tube 13 is rigidly supported by the first tubular locker 31 and the second tubular locker 32, so as to prevent any unwanted movement of the gas tube 13.

As shown in FIG. 2, the handguard body 20, the barrel locker 30, and the handguard locker 40 are detachably coupled with each other via a fastening module 50. The fastening module 50 comprises a first fastening unit 51, a second fastening unit 52, and a third fastening unit 53.

The first fastening unit 51 contains a plurality of first slots 511 indented on edges of the locking ribs 314 of the first tubular locker 31 respectively, one or more first screw apertures 512 formed at the rear portion 41 of the handguard locker 40, and one or more first screw holes 513 formed at the first end portion 21 of the handguard body 20. The first fastening unit 51 further comprises one or more first screws 514. When the rear portion 41 of the handguard locker 40 is coupled at the rear locking portion 311 of the first tubular locker 31, the first screw apertures 512 are aligned with the first slots 511 respectively. When the first end portion 21 of the handguard body 20 is coupled at the handguard locker 40, the first screw holes 513 are aligned with the first screw apertures 512 respectively. Therefore, the first slots 511, the first screw apertures 512, and the first screw holes 513 are aligned with each other, such that the first screws 514 are rotatably engaged through the first slots 511, the first screw apertures 512, and the first screw holes 513 to securely couple the handguard body 20, the first tubular locker 31 and the handguard locker 40 with each other.

The second fastening unit 52 contains one or more second screw apertures 521 formed at the second tubular locker 32, and one or more second screw holes 522 formed at the front portion 42 of the handguard locker 40. The second fastening unit 52 further comprises one or more second screws 523. When the front portion 42 of the handguard locker 40 is coupled at the second tubular locker 32, the screw apertures 521 are aligned with the second screw holes 522 respectively, such that the second screws 523 are rotatably engaged through the screw apertures 521 and the second screw holes 522 to securely couple the handguard locker 40 at the second tubular locker 32.

The third fastening unit 53 contains one or more third slots 531 formed at the front portion 42 of the handguard locker 40, one or more third screws holes 532 formed at the first end portion 21 of the handguard body 20, and one or more third screw apertures 534 formed at the second tubular locker 32. The third fastening unit 53 further comprises one or more third screws 533. Accordingly, the second screw apertures 521 and the third screw apertures 534 are formed at the second tubular locker 32 at different faces thereof, wherein the second screw apertures 521 are positioned alternating with the third screw apertures 534. In addition, the third slots 531 and the second screw holes 522 are formed at the front portion 42 of the handguard locker 40 at different faces thereof, wherein the third slots 531 are positioned alternating with the second screw holes 522. When the first end portion 21 of the handguard body 20 is coupled at the handguard locker 40, the third screw holes 532, the third slots 531, and the third screw apertures 534 are aligned with each other, such that the third screws 533 are rotatably engaged through the third slots 531, the third screw holes 532, and the third screw apertures 534 to securely couple the handguard body 20 at the handguard locker 40 and the second tubular locker 32.

In order to install the free float handguard of the present invention into the firearm, the mounting method of the free float handguard comprises the following step.

(1) Coaxially couple the first tubular locker 31 to the fixed end of the barrel 12. Accordingly, the user is able to pass the barrel 12 through the first tubular locker 31 and to rotate the first tubular locker 31 for rotatably engaging the inner threaded structure 313 at the fixed end of the barrel 12. It is worth mentioning that when the gas tube 13 is provided, the user should detach the gas tube 13 from the firearm before coupling the first tubular locker 31.

(2) Couple the handguard locker 40 at the first tubular locker 31. In particular, the user is able to pass the barrel 12 through the handguard locker 40, wherein the rear portion 41 of the handguard locker 40 is coupled at the first tubular locker 31. It is worth mentioning that the gas tube channel is aligned and located along the gas tube slit 47. Then, the gas tube 13 can be re-coupled at the firearm at a position that the gas tube 13 is extended through the gas tube channel.

(3) Coaxially couple the second tubular locker 32 at the front coupling portion 312 of the first tubular locker 31 and the handguard locker 40, wherein the front portion 42 of the handguard locker 40 is coupled at the second tubular locker 32. In addition, the retention ring 33 is coupled at the front coupling portion 312 of the first tubular locker 31 to retain the second tubular locker 32 between the rear locking portion 311 of the first tubular locker 31 and the retention ring 33. In other words, the front ends of the engaging ribs 45 are biased against the second tubular locker 32, such that when the retention ring 33 is locked at the front end of the front coupling portion 312 of the first tubular locker 31, the second tubular locker 32 will be locked at the front coupling portion 312 of the first tubular locker 31 to prevent an axial movement of the handguard locker 40 along the barrel direction.

Accordingly, the user is able to pass the barrel 12 through the second tubular locker 32 and pass the front coupling portion 312 of the first tubular locker 31 through the second tubular locker 32 in order to couple the second tubular locker 32 at the front coupling portion 312 of the first tubular locker 31 and to couple the second tubular locker 32 at the front portion 42 of the handguard locker 40. It is worth mentioning that the second tubular locker 32 is coaxially slid at the front coupling portion 312 of the first tubular locker 31 until the second tubular locker 32 is blocked by front ends of the engaging ribs 45 of the handguard locker 40. The second tubular locker 32 is then retained at the front coupling portion 312 of the first tubular locker 31 to align the gas tube slot 323 with the gas tube channel. It is worth mentioning that the gas tube slot 323 faces upward when the second tubular locker 32 is coaxially slid at the front coupling portion 312 of the first tubular locker 31 to automatically align with the gas tube channel. Then, the second screws 523 are rotatably engaged through the screw apertures 521 and the second screw holes 522 to securely couple the handguard locker 40 at the second tubular locker 32.

It is worth mentioning that the gas tube channel and the gas tube slot 323 are aligned located along the gas tube slit 47. Then, the gas tube 13 can be re-coupled at the firearm at a position that the gas tube 13 is extended through the gas tube channel and the gas tube slot 323. In addition, the retention ring 33 is coupled at the front coupling portion 312 of the first tubular locker 31 to retain the second tubular locker 32 between the rear locking portion 311 of the first tubular locker 31 and the retention ring 33.

(4) Couple the handguard body 20 to the barrel 12 via the locking arrangement. The user is able to pass the barrel 12 through the handguard body 20 until the first end portion 21 of the handguard body 20 is coupled at the handguard locker 40 for locking up the handguard body 20 around the barrel 12. The first screws 514 are then rotatably engaged through the first slots 511, the first screw apertures 512, and the first screw holes 513 to securely couple the handguard body 20, the first tubular locker 31 and the handguard locker 40 with each other. In addition, the third screws 533 are rotatably engaged through the third slots 531, the third screw holes 532, and the third screw apertures 534 to securely couple the handguard body 20 at the second tubular locker 32 and the handguard locker 40. In other words, two different fastening structures are provided at the handguard body 20 to rigidly retain the position of the handguard body 20 by providing the first fastening unit 51 to fasten the handguard body 20 to the first tubular locker 31 and the handguard locker 40, and by providing a third fastening unit 53 to fasten the handguard body 20 to the second tubular locker 32 and the handguard locker 40. It is worth mentioning that the gas tube 13 is extended within the handguard body 20 after the handguard body 20 is coupled to encircle the barrel 12. It is worth mentioning the barrel locker 30 and the handguard locker 40 are encircled within the first end portion 21 of the handguard body 20, such that the barrel locker 30 and the handguard locker 40 are hidden after the handguard body 20 is mounted to encircle the barrel 12.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A free float handguard for a firearm having a barrel, comprising:

a handguard body, which has a tubular configuration, having a first end portion and a second end portion; and a locking arrangement which locks at said first end portion of said handguard body to suspendedly support said second end portion thereof for encircling around the barrel, wherein said locking arrangement comprises:

a barrel locker which comprises:

a first tubular locker adapted for coaxially coupling at a fixed end of the barrel, wherein said first tubular locker has a rear locking portion and a front coupling portion, wherein said first tubular locker further comprises a plurality of locking ribs outwardly and radially extended from said rear locking portion to form a plurality of locking grooves between said locking ribs;

a second tubular locker coaxially coupled at said first tubular locker, wherein said second tubular locker is coaxially and rotatably coupled at said front coupling portion of said first tubular locker, wherein said second tubular locker has a circular inner surface and a non-circular outer surface, such that when said circular inner surface of said second tubular locker is coupled at said front coupling portion of said first tubular locker, said second tubular locker is adapted to be rotated around said front coupling portion of said first tubular locker; and a handguard locker having a rear portion coaxially coupled at said first tubular locker to prevent said handguard locker from being rotated therearound, and a front portion engaged with said second tubular locker, wherein said first end portion of said handguard body is coupled at said handguard locker for locking up said handguard body around the barrel, wherein said front portion of said handguard locker is coaxially coupled at said second tubular locker to prevent said second tubular locker from being rotated around said first tubular locker, wherein said handguard locker further has an inner circumferential surface, wherein said inner circumferential surface of said handguard locker at said rear portion thereof is engaged with said rear locking portion of said first tubular locker and said inner circumferential surface of said handguard locker at said front portion thereof is biased against said non-circular outer surface of said second tubular locker so as to lock up said handguard body around the barrel, wherein said plurality of locking ribs outwardly and radially extended from said rear locking portion forming said plurality of locking grooves between said locking ribs is engaged with said rear portion of said inner circumferential surface of said handguard locker.

2. The free float handguard, as recited in claim 1, wherein said handguard locker further has an outer circumferential surface coupled with said first end portion of said handguard body, wherein said outer circumferential surface of said handguard has a cross section matching a cross section of said handguard body.

3. The free float handguard, as recited in claim 1, wherein said handguard locker further comprises a plurality of engaging ribs inwardly and radially extended from said rear portion of said inner circumferential surface to form a plurality of engaging grooves between said engaging ribs, such that said locking ribs are engaged with said engaging grooves while said engaging ribs are engaged with said locking grooves to interlock said handguard locker with said first tubular locker.

4. The free float handguard, as recited in claim 2, wherein said handguard locker further comprises a plurality of engaging ribs inwardly and radially extended from said rear portion of said inner circumferential surface to form a plurality of engaging grooves between said engaging ribs, such that said locking ribs are engaged with said engaging grooves while said engaging ribs are engaged with said locking grooves to interlock said handguard locker with said first tubular locker.

5. The free float handguard, as recited in claim 4, wherein said front portion of said inner circumferential surface of said handguard locker has a non-circular configuration matching with a cross section of said non-circular outer surface of said second tubular locker, such that when said front portion of said inner circumferential surface of said handguard locker is engaged with said non-circular outer surface of said second tubular locker, said second tubular locker is locked up at said front coupling portion of said first tubular locker to block said second tubular locker to be rotated at said front coupling portion of said tubular locker.

6. The free float handguard, as recited in claim 1, wherein one of said locking grooves serves as a gas tube channel for guiding and supporting a gas tube of the firearm extended toward the barrel.

7. The free float handguard, as recited in claim 5, wherein one of said locking grooves serves as a gas tube channel for guiding and supporting a gas tube of the firearm extended toward the barrel.

8. The free float handguard, as recited in claim 6, wherein said second tubular locker further has a gas tube slot indented on said non-circular outer surface of said second tubular locker, such that said second tubular locker rotated at said front coupling portion of said first tubular locker to align said gas tube slot with said gas tube channel for guiding and supporting the gas tube of the firearm extended toward the barrel.

9. The free float handguard, as recited in claim 7, wherein said second tubular locker further has a gas tube slot indented on said non-circular outer surface of said second tubular locker, such that said second tubular locker rotated at said front coupling portion of said first tubular locker to align said gas tube slot with said gas tube channel for guiding and supporting the gas tube of the firearm extended toward the barrel.

10. The free float handguard, as recited in claim 6, wherein said handguard locker has a C-shape defining a gas tube slit between two edges thereof to align with said gas tube channel for guiding the gas tube of the firearm extended toward the barrel.

11. The free float handguard, as recited in claim 7, wherein said handguard locker has a C-shape defining a gas tube slit between two edges thereof to align with said gas tube channel for guiding the gas tube of the firearm extended toward the barrel.

12. The free float handguard, as recited in claim 9, wherein said handguard locker has a C-shape defining a gas tube slit between two edges thereof to align with said gas tube channel for guiding the gas tube of the firearm extended toward the barrel.

13. The free float handguard, as recited in claim 12, wherein said first tubular locker has an inner threaded structure for rotatably coupling at the fixed end of the barrel.

14. A free float handguard for a firearm having a barrel, comprising:

a handguard body, which has a tubular configuration, having a first end portion and a second end portion; and a locking arrangement which locks at said first end portion of said handguard body to suspendedly support said second end portion thereof for encircling around the barrel, wherein said locking arrangement comprises:

a barrel locker which comprises:

a first tubular locker adapted for coaxially coupling at a fixed end of the barrel, wherein said first tubular locker has a rear locking portion and a front coupling portion;

a second tubular locker coaxially coupled at said first tubular locker, wherein said second tubular locker is coaxially and rotatably coupled at said front coupling portion of said first tubular locker, wherein said second tubular locker has a circular inner surface and a non-circular outer surface, such that when said circular inner surface of said second tubular locker is coupled at said front coupling portion of said first tubular locker, said second tubular locker is adapted to be rotated around said front coupling portion of said first tubular locker; and a handguard locker having a rear portion coaxially coupled at said first tubular locker to prevent said handguard locker from being rotated therearound, and a front portion engaged with said second tubular locker, wherein said first end portion of said handguard body is coupled at said handguard locker for locking up said handguard body around the barrel, wherein said front portion of said handguard locker is coaxially coupled at said second tubular locker to prevent said second tubular locker from being rotated around said first tubular locker, wherein said handguard locker further has an inner circumferential surface, wherein said inner circumferential surface of said handguard locker at said rear portion thereof is engaged with said rear locking portion of said first tubular locker and said inner circumferential surface of said handguard locker at said front portion thereof is biased against said non-circular outer surface of said second tubular locker so as to lock up said handguard body around the barrel, wherein said front portion of said inner circumferential surface of said handguard locker has a non-circular configuration matching with a cross section of said non-circular outer surface of said second tubular locker, such that when said front portion of said inner circumferential surface of said handguard locker is engaged with said non-circular outer surface of said second tubular locker, said second tubular locker is locked up at said front coupling portion of said first tubular locker to block said second tubular locker to be rotated at said front coupling portion of said tubular locker.

* * * * *